US006334563B1

(12) United States Patent
Schwede

(10) Patent No.: US 6,334,563 B1
(45) Date of Patent: Jan. 1, 2002

(54) RETENSIONING DEVICE FOR STRAPPING MACHINES

(75) Inventor: Roland Schwede, Goldkronach (DE)

(73) Assignee: SMB Schwede Maschinenbau GmbH, Goldkronach (DE)

( * ) Notice: Subject to any disclaimer, the term of this patent is extended or adjusted under 35 U.S.C. 154(b) by 0 days.

(21) Appl. No.: 09/566,487

(22) Filed: May 8, 2000

(30) Foreign Application Priority Data

May 5, 1999 (DE) ..... 199 20 531
May 27, 1999 (DE) ..... 199 24 352

(51) Int. Cl.[7] ..... B65B 13/22; B65H 20/36; B65H 23/188

(52) U.S. Cl. ..... 226/35; 100/4; 100/32

(58) Field of Search ..... 242/419.1, 418.1, 242/419.5; 100/29, 32, 4; 226/35, 154, 155, 187; 254/215, 216; 53/589

(56) References Cited

U.S. PATENT DOCUMENTS 4,995,776 A * 2/1991 Kato ..... 100/32
5,509,594 A * 4/1996 Maggioni ..... 226/35
6,041,581 A * 3/2000 Huber ..... 53/589
6,041,698 A * 3/2000 Chin-Chang ..... 100/32

FOREIGN PATENT DOCUMENTS

| | | | |
|---|---|---|---|
| DE | 3249559 | C2 | 10/1987 |
| DE | 3249558 | C2 | 1/1988 |
| DE | 19505093 | C1 | 10/1996 |
| EP | 0795475 | A1 | 3/1997 |

* cited by examiner

*Primary Examiner*—John M. Jillions
(74) *Attorney, Agent, or Firm*—Browdy and Neimark

(57) ABSTRACT

A retensioning device for strapping machines is provided with a pair of tape tensioning rollers comprising a stationary counter roller and a pivoting roller which can be adjusted towards it. A strapping tape is guided through the nip and via an angle of wrap round the pivoting roller.

The pivoting roller is mounted on a pivoting lever which can be loaded with a defined force. The retensioning force building up in the strapping tape is opposed to the loading force in such a way that the pivoting roller lifts momentarily from the counter roller when the loading force is exceeded and therefore interrupts the retensioning process.

9 Claims, 1 Drawing Sheet

RETENSIONING DEVICE FOR STRAPPING MACHINES

BACKGROUND OF THE INVENTION

1. Field of the Invention

The invention relates to a retensioning device for strapping machines.

2. Background Art

It should be mentioned as the background of the invention that strapping machines normally have a tape guide frame which is constructed vertically on a work table and in which a stack of products, for example a stack of periodicals, to be strapped with a tape is introduced. A strapping tape is then pulled off a supply roll by a tape drive device and shot into the tape guide frame until the leading end of the tape enters a welding arrangement beneath the stack of products in the work table. The leading end is held and the strapping tape retracted by a retractor. It issues from the tape guide frame and wraps itself round the stack of products.

In this state, the strapping tape has to be tightened round the stack of products with a defined retensioning force. This retensioning force is controlled for various reasons and is difficult in many respects. It can basically be assumed that retensioning takes place with a pair of tape tensioning rollers through whose nip the strapping tape passes. The contact between strapping tape and pair of rollers accordingly has to be controlled in such a way that the force exerted on the tape and causing the retensioning can be defined. This is due to the technical requirement of strapping, for example, a stack of periodicals with a few copies only with a slight retensioning force owing to its low flexibility, whereas a high stack of periodicals is to be strapped with a far greater retensioning force owing to the compressibility of the periodicals and the much greater stability of the stack to kinking of the individual volumes. It must be possible to adjust the retensioning force individually from stack to stack as stacks which follow one another directly and have markedly differing heights have to be processed in the strapping machine in modern packaging lines of, for example, printing plant.

The retensioning force which can be produced in the strapping tape by the pair of tape tensioning rollers is accordingly dependent on very different parameters, for example the coefficient of friction between the strapping belt and the rollers, the force with which the two rollers are pressed toward one another and the angle of wrap with which the tape is generally guided round one of the two rollers. Furthermore, the torque provided by the rollers obviously has a significant influence on the retensioning force.

DE 32 49 559 C2 shows a feed and tensioning device for a strapping tape which is to be tensioned round a package. A revolving pressure roller is provided as counter roller which cooperates with a tensioning wheel, arranged on a pivoting lever, as pivot roller. Tape guide and angle of wrap of the retensioning device shown therein are designed in such a way that the pivoting lever is loaded by the retensioning force building up during the retensioning process via the pivoting roller in such a way that the pivoting roller is pressed against the counter roller. The feed force which can be exerted on the tape is therefore increased. The completion of the retensioning process and, in particular, the drive of the pivoting roller are controlled by the excursion of the pivoting lever. On attainment of a specific force, the pivoting lever is deflected so far from its spring-loaded basic position that a contact switch for the drive motor of the pivoting roller is actuated and the motor is switched off. The maximum retensioning force can be adjusted by an energy store in the form of a helical compression spring which loads the pivoting lever against its excursion direction. The bias of the helical compression spring and therefore the loading of the pivoting lever can be adjusted by means of a hand wheel. Therefore, the maximum retensioning force cannot be adjusted in an economical and automatable manner.

It can be seen that the above-described retensioning device according to the prior art has a very complex construction and can only be controlled with difficulty with respect to the adjustment and control of the retensioning process. This is all the more problematic since modem strapping machines operate with extremely short cycle times of less than one second. This means that the actual retensioning process lasts only one to two tenths of a second and therefore does not allow a time frame for complicated control measures.

SUMMARY OF THE INVENTION

Starting from the aforementioned problems, the object of the invention is to provide a retensioning device which, despite its simplicity of construction, makes possible proper control of the retensioning force, in particular also with respect to extremely quick retensioning processes.

This object is achieved by the loading device for the defined loading of the lever being accordingly coupled to the pivoting lever so that the pivoting roller can be adjusted toward the counter roller with a defined loading force. This loading force opposes the retensioning force building up in the tape during the retensioning process in such a way that the pivoting roller momentarily lifts from the counter roller when the loading force is exceeded and therefore interrupts the retensioning process. Owing to the lifting of the pivoting roller from the counter roller, the strapping tape becomes virtually free so the retensioning force collapses and the pivoting roller can be pressed back against the counter roller by means of the loading device. The tape is therefore retensioned again and the foregoing sequence of operation is repeated within the retensioning device. An equilibrium of forces is adjusted overall owing to the opposing forces on the lever, and the retensioning force which can be produced in the strapping tape can be controlled as a function of the loading force of the pivoting lever and by means of it. On attainment of the maximum retensioning force, a mechanical control circuit comes into effect in practice owing to the excursion of the pivoting lever and keeps the retensioning force almost constant during rotation of the roller.

Further features, details and advantages of the invention can be inferred from the following description in which an embodiment of the subject of the invention is described in more detail with reference to the accompanying drawings.

DESCRIPTION OF THE PREFERRED EMBODIMENT

Figure 1:
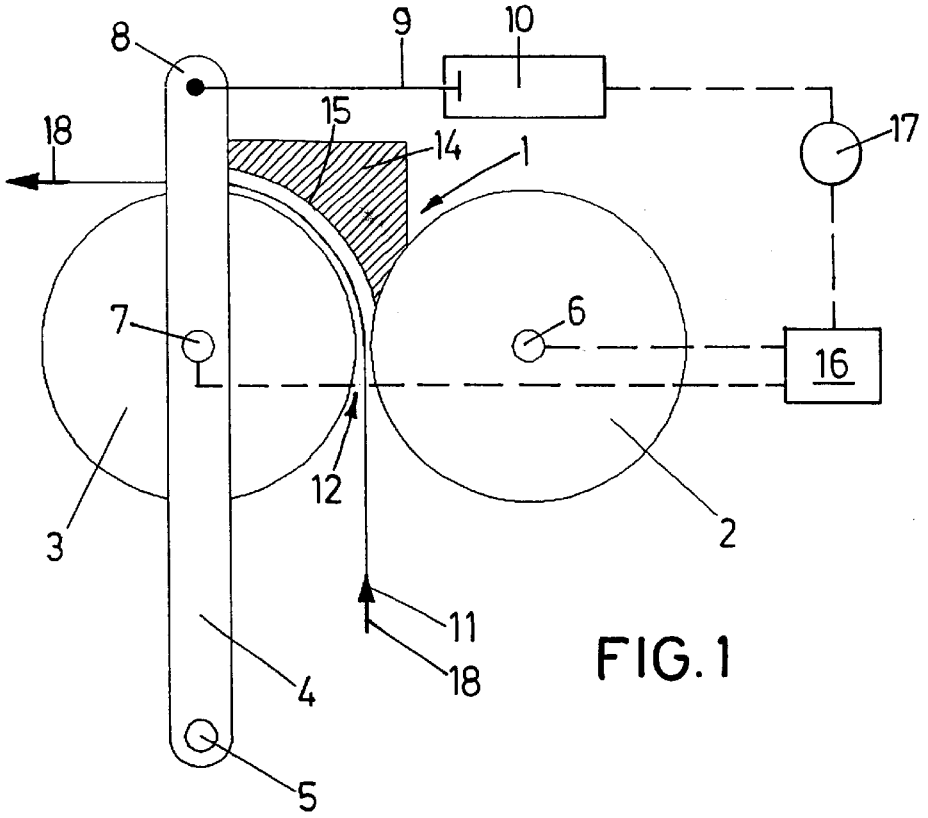
FIG. 1 is a highly schematic side view of a retensioning device in the inactive state.

The retensioning device shown in the two figures is arranged in the base of a strapping machine below its work table. At its heart, it has a pair of tape tensioning rollers 1 formed, on the one hand, by a stationary, rotatably mounted counter roller 2 and a pivoting roller 3. The pivoting roller 3 is mounted rotatably on a one-armed pivoting lever 4 of which the pivot axis 5 extends parallel to the two axes of rotation 6, 7 of the counter and pivoting roller 2, 3. The piston rod 9 of a pneumatic cylinder 10 acts on the free end 8 of the pivoting lever 4, loads the pivoting lever 4 in a direction at right angles to itself with a defined force $F_{cyl}$ and therefore presses the pivoting roller 3 toward the counter roller 2 of the pair of tape tensioning rollers 1.

Figure 2:
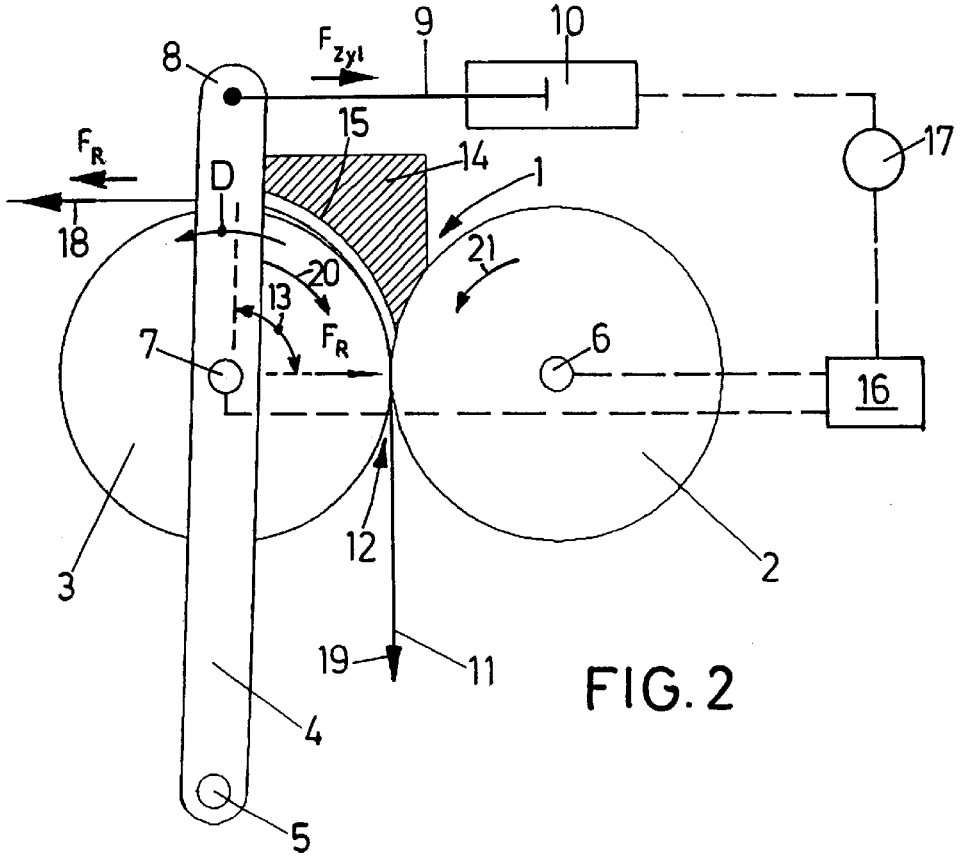
FIG. 2 is a side view similar to FIG. 1 in the active state of the retensioning device.

As also shown in FIGS. 1 and 2, a strapping tape 11 is guided from a tape store, not shown, on the side facing the pneumatic cylinder 10 to the pair of tape tensioning rollers 1 and into the nip 12 formed between counter and pivoting roller 2, 3. The strapping tape 11 is then guided via an angle of wrap 13 round the pivoting roller 3. The strapping tape 11 is guided away from the pivoting roller 3 after the angle of wrap 13 in such a way that it runs away in a direction exactly opposed to the piston rod 9 or the cylinder force $F_{cyl}$.

A tape guide rail 14 which brushes the angle of wrap 13 with its tape guide face 15 describing a quadrant is indicated in hatching in FIGS. 1 and 2. The tape guide rail 14 serves to guide the strapping tape 11 while the strapping tape 11 is shot into the strapping machine.

In terms of control and operation, it should be added with respect to the retensioning device that the two rollers 2, 3 are driven synchronously and in opposite directions 20, 21 by a motor 16 which can be switched on and off via a controller 17. The loading pressure of the pneumatic cylinder 10 can also be adjusted so the cylinder force $F_{cyl}$ can be varied rapidly and over wide ranges. This is also effected via corresponding activation of the pneumatic cylinder 10 by means of the controller 17.

The mode of operation of the retensioning device shown in FIGS. 1 and 2 can be explained as follows:

FIG. 1 shows the inactive position of the retensioning device in which the strapping tape 11 is shot into the strapping tape machine. The pneumatic cylinder 10 is set in such a way that the piston rod 9 is driven out to a maximum and the pair of tape tensioning rollers 1 is open. This means that no force can be exerted on the strapping tape 11 despite a rotation of the rollers 2, 3 counter to the shooting direction 18. The strapping tape 11 is guided along the tape guide face 15 of the rail 14 through the machine and is handled in a known manner in the strapping machine.

The retensioning device comes into action after retraction of the tape 11 from the tape guide frame of the strapping machine and application of the strapping tape 11 round the stack of products to be strapped. For this purpose, the pneumatic cylinder 10 is activated and loaded with a force defined by the controller 17. The pivoting lever 4 is thus deflected in a clockwise direction with respect to FIG. 2 and the pivoting roller 3 is adjusted toward the counter roller 2 while closing the nip 12. The strapping tape 11 is grasped by the pair of tape tensioning rollers 1 and pulled in the retensioning direction 19. A force $F_R$ which is dependent on the pressing force in the nip 12, the frictional force which can be exerted on the tape by the rollers 2, 3 and the angle of wrap 13 act on the tape. As the retraction of the strapping tape 11 increases, the strapping tape 11 is placed increasingly tightly round the stack of products to be strapped so that a retensioning force $F_{re}$ builds up in the tape. This retensioning force $F_{re}$ produces a torque D on the pivoting lever 4 which counteracts the loading force $F_{cyl}$. As soon as this force is exceeded, the pivoting lever 4 is pivoted out in an anticlockwise direction with respect to FIG. 2 and the nip 12 opens somewhat. The force which is indicated as a whole by $F_R$ in FIG. 2 and can be exerted on the tape and, with it, the retensioning force $F_{re}$ therefore collapses momentarily so that the pivoting lever 4 can be pivoted back into the closing direction. The retensioning force $F_{re}$ is accordingly built up again and the foregoing process is repeated cyclically, the cycle time ranging from a few thousandths to hundredths of a second. It should also be mentioned that the pivot path of the pivoting lever 4 moves in the plastic range of the tape and cannot be measured in practice.

The foregoing statements show that the retensioning force $F_{re}$ can be varied by the adjustment of the loading force $F_{cyl}$ via the pneumatic cylinder 10. It should also be mentioned that the torque of the motors does not have to be controllable for adjusting the retensioning force $F_{re}$. Rather, the invention provides a very simply operating, mechanical control circuit with which the retensioning process can be completed by pure timing. If, for example, the actual retensioning process lasts 0.08 seconds and the subsequent welding of the strapping tape 0.05 seconds, it is sufficient to activate the pair of tape tensioning rollers 1 over a period of, for example, 0.15 seconds with a defined loading force $F_{cyl}$ on the pneumatic cylinder 10 in order to guarantee specific retensioning and welding of the tape while maintaining this retensioning. The next strapping process can then be effected in the described manner by activation of the pair of tape tensioning rollers 1.

It is pointed out that the loading device for the pivoting lever 4 can also be produced by an electromagnetic lifting device or a spring arrangement of which the bias is mechanically adjustable.

To sum up, the retensioning device according to the invention has various advantages:

- Only one time set value and one set value for the loading force of the pneumatic cylinder 10 have to be predetermined for the controller. The actual control of retensioning is then effected "in situ" by the mechanical control circuit.
- The retensioning force is infinitely variable linearly from the smallest values close to zero to a maximum force value.
- The mechanism is easy to construct and to service. Complex adjustment work is not required.
- The retensioning device runs very quietly as no component has to overcome large ranges.

What is claimed is:

1. A retensioning device for strapping machines comprising a pair of tape tensioning rollers (1) comprising a stationary, rotatably mounted counter roller (2) and a pivoting roller (3) which is rotatably mounted on a pivoting lever (4) and can be adjusted toward the counter roller (2) for tightening of a strapping tape (11) placed around a stack of products in the strapping machine, the strapping tape (11) being guided between a nip (12) formed by counter roller (2) and pivoting roller (3) and being guided over an angle of wrap (13) around the pivoting roller (3), and a loading device (10) which is coupled to the pivoting lever (4) for a defined loading of the pivoting lever (4) in such a way that the pivoting roller (3) can be adjusted with a defined loading force ($F_{cyl}$) against the counter roller (2), a retensioning force ($F_{re}$) building up in the strapping tape (11) during a retensioning process being opposed to the loading force ($F_{cyl}$) in such a way that the pivoting roller (3) momentarily lifts from the counter roller (2) when the loading force ($F_{cyl}$) is exceeded and therefore cyclically interrupts the retensioning process.

2. A retensioning device according to claim 1, comprising a controller (17) for timing the roller drive during the retensioning process.

3. A retensioning device according to claim 1, wherein the defined loading of the pivoting lever (3) takes place with a variable loading force ($F_{cyl}$).

4. A retensioning device according to claim 1, wherein the loading device is formed by a pneumatic cylinder (10) of adjustable pressure.

5. A retensioning device according to claim 1, wherein the loading device is formed by an electromagnetic lifting device.

6. A retensioning device according to claim 1, wherein the loading device is formed by a spring arrangement which is mechanically adjustable in its bias.

7. A retensioning device according to claim 1, wherein the angle of wrap (13) is about 90°.

8. A retensioning device according to claim 1, wherein the strapping tape (11) is guided away from the pivoting roller (3) in such a way that the retensioning force ($F_{re}$) is directed at right angles to the pivoting lever (4) of the pivoting roller (3).

9. A retensioning device according to claim 1, comprising a tape guide rail (14) which is associated with the pivoting roller (3) and brushes the angle of wrap (13) of the strapping tape (11) for guiding the strapping tape (11) as the strapping tape (11) is shot into the strapping machine in a direction opposed to the retensioning.

* * * * *